US012766661B2

(12) United States Patent
Dunn

(10) Patent No.: US 12,766,661 B2
(45) Date of Patent: Oct. 20, 2026

(54) FIBER POLISHING SYSTEM

(71) Applicant: viaPhoton, Inc., Aurora, IL (US)

(72) Inventor: Morgan Dunn, Dallas, TX (US)

( * ) Notice: Subject to any disclaimer, the term of this patent is extended or adjusted under 35 U.S.C. 154(b) by 366 days.

(21) Appl. No.: 18/486,655

(22) Filed: Oct. 13, 2023

(65) Prior Publication Data

US 2024/0123562 A1 Apr. 18, 2024

Related U.S. Application Data

(60) Provisional application No. 63/415,964, filed on Oct. 13, 2022.

(51) Int. Cl.

| | |
|---|---|
| ***B24B 19/22*** | (2006.01) |
| ***B24B 51/00*** | (2006.01) |
| ***B24B 53/007*** | (2006.01) |

(52) U.S. Cl.

CPC ..... *B24B 19/226* (2013.01); *B24B 51/00* (2013.01); *B24B 53/007* (2013.01)

(58) Field of Classification Search

CPC ..... B24B 19/226; B24B 51/00; B24B 53/007
See application file for complete search history.

(56) References Cited

U.S. PATENT DOCUMENTS

| | | | | | |
|---|---|---|---|---|---|
| 1,883,861 | A * | 10/1932 | Baker | D06F 71/023 | 38/30 |
| 2,075,369 | A * | 3/1937 | Stetler | B24B 7/222 | 15/49.1 |
| 4,538,383 | A * | 9/1985 | Le Marer | G02B 6/3885 | 269/274 |
| 5,806,124 | A * | 9/1998 | Schneider | B08B 3/08 | 15/77 |
| 6,309,284 | B1 * | 10/2001 | Chou | B24B 19/226 | 451/271 |
| 12,280,467 | B1 * | 4/2025 | Watson | B24B 19/226 | |
| 2004/0237331 | A1 * | 12/2004 | Sarfaty | B24B 19/226 | 34/218 |
| 2011/0209729 | A1 * | 9/2011 | Beaudet | A47L 15/0021 | 134/18 |

* cited by examiner

*Primary Examiner* — Nathaniel E Wiehe
*Assistant Examiner* — Joshua R Beebe
(74) *Attorney, Agent, or Firm* — Ferguson Braswell Fraser Kubasta PC

(57) ABSTRACT

A method for polishing fibers implements a fiber polishing system. The method includes manipulating a disk, spraying water using a first water pressure, and spraying air using an air pressure. The method further includes misting low pressure water using a second water pressure, manipulating a handle, and manipulating one or more dogs.

20 Claims, 4 Drawing Sheets

FIBER POLISHING SYSTEM

CROSS REFERENCE TO RELATED APPLICATIONS

This application claims the benefit of U.S. Provisional Application No. 63/415,964, filed Oct. 13, 2022, which is hereby incorporated by reference herein.

BACKGROUND

Fiber polishing stations are used to refine the surfaces of optical fibers. The fibers, often made of glass or plastic, possess intricate structures that require precise treatment to achieve desired optical properties. Fiber polishing uses a controlled environment where factors such as pressure, abrasion, and polishing material may be precisely regulated. The fiber polishing station provides a designated space equipped with machinery to perform the polishing process, which may be performed in an automated or partially automated manner. A challenge with fiber polishing stations is providing for the precise replication of skilled tasks and simple repetitive tasks while reducing wait times.

SUMMARY

In general, in one or more aspects, the disclosure relates to a method for polishing fibers that implements a fiber polishing system. The method includes manipulating a disk, spraying water using a first water pressure, and spraying air using an air pressure. The method further includes misting low pressure water using a second water pressure, manipulating a handle, and manipulating one or more dogs.

Other aspects of the one or more embodiments will be apparent from the following description and the appended claims.

BRIEF DESCRIPTION OF DRAWINGS

Like elements in the various figures are denoted by like reference numerals for consistency.

DETAILED DESCRIPTION

Figure 1:
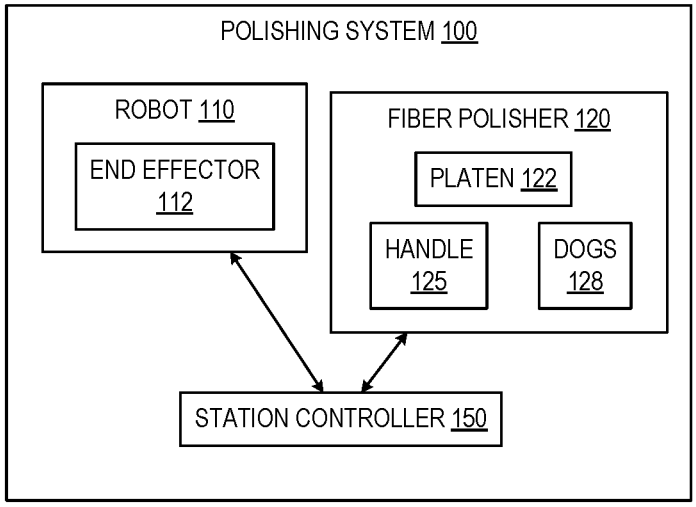
FIG. 1 shows a diagram of a system in accordance with disclosed embodiments.

Turning to FIG. 1, the polishing system (100) polishes the fibers of fiber optic cables. The polishing system (100) includes the robot (110), the fiber polisher (120), and the station controller (150). The polishing system (100) may have one or multiple fiber polisher (120).

The robot (110) manipulates the fiber polisher (120) to polish fibers inserted into the fiber polisher (120). The robot (110) includes the end effector (112).

The end effector (112) is a device at an end of an arm of the robot (110) that includes multiple tools. The tools of the end effector (112) may perform multiple different actions, including gripping objects, spraying gases, spraying fluids, manipulating objects, etc.

The fiber polisher (120) polishes fibers. The fiber polisher (120) includes the platen (122), the handle (125), and the dogs (128).

The platen (122) is a part of the fiber polisher (120). The fiber polisher (120) presses the fibers against a polishing disk. The platen is a precision flat plate, situated opposite the polishing disk, with receptacles for the fiber optic connectors to be polished. The platen uses the latching mechanism of the connector of the fiber to lock the connector into place during polishing.

The handle (125) is a part of the fiber polisher (120). The handle (125) is used to open and close the fiber polisher (120) to manipulate the polishing disk.

The dogs (128) are a part of the fiber polisher (120). Manipulating the dogs (128) locks the fiber polisher (120) closed during the polishing of the fibers.

Figure 4A:
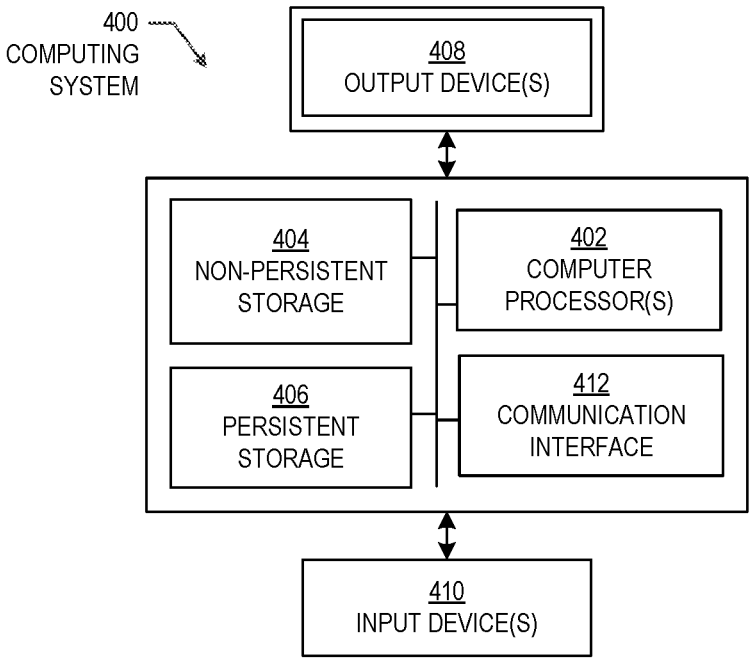
FIG. 4A and FIG. 4B show computing systems in accordance with disclosed embodiments.
Figure 4B:
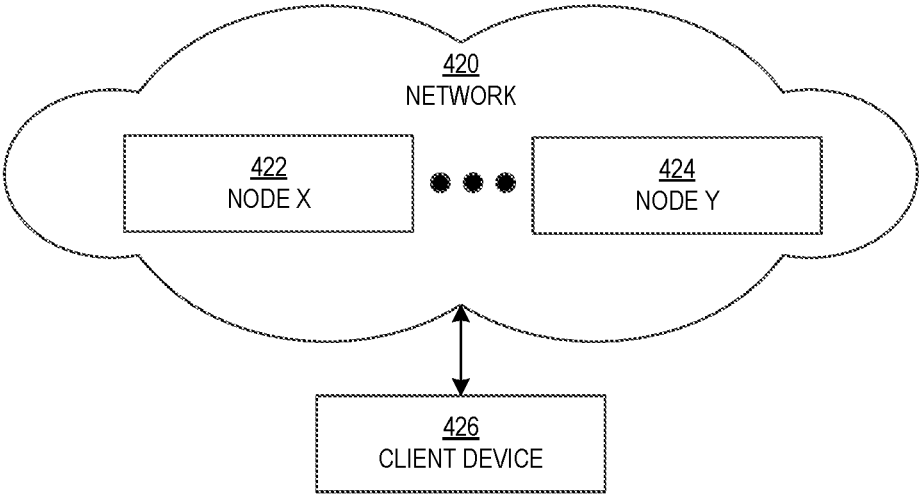

The station controller (150) is a computing device in accordance with those described in FIGS. 4A and 4B. The station controller (150) controls the robot (110) and the fiber polisher (120) to perform one or multiple polishing cycles.

Figure 2:
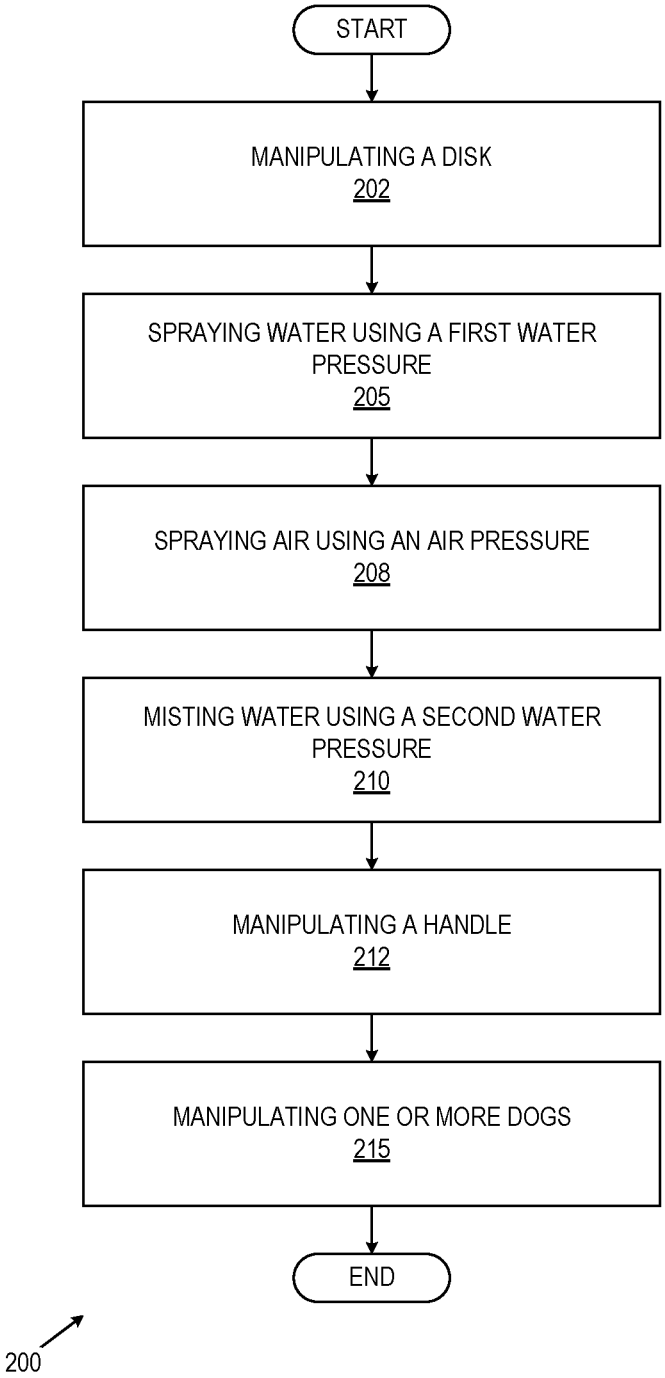
FIG. 2 shows a flowchart in accordance with disclosed embodiments.

Turning to FIG. 2, the process (200) implements a method of polishing. The process (200) may be performed with a computing device, including the station controller (150) of FIG. 1.

At Step 202, a disk is manipulated. The disk is a polishing disk that may be removed from a fiber polisher.

At Step 205, water is sprayed using a first water pressure. In one embodiment, the water is sprayed using a high enough pressure to clean the disk. In one embodiment, the pressure range for the high pressure water is 100 to 120 pounds per square inch (PSI).

At Step 208, spraying air using an air pressure. The air pressure may be sufficient to remove excess water from the disk. In one embodiment, the pressure range for the high pressure air is 100 to 120 PSI.

At Step 210, water is misted using a second water pressure. In one embodiment, the second water pressure may be lower than the first water pressure. In one embodiment, the pressure range for the low pressure water is 50 to 60 PSI.

At Step 212, a handle is manipulated. In one embodiment, the handle is manipulated to close the fiber polisher after inserting the disk into the fiber polisher.

At Step 215, one or more dogs of the fiber polisher are manipulated. In one embodiment, the dogs are manipulated to lock the fiber polisher closed during polishing of the fibers inserted into the fiber polisher.

Figure 3:
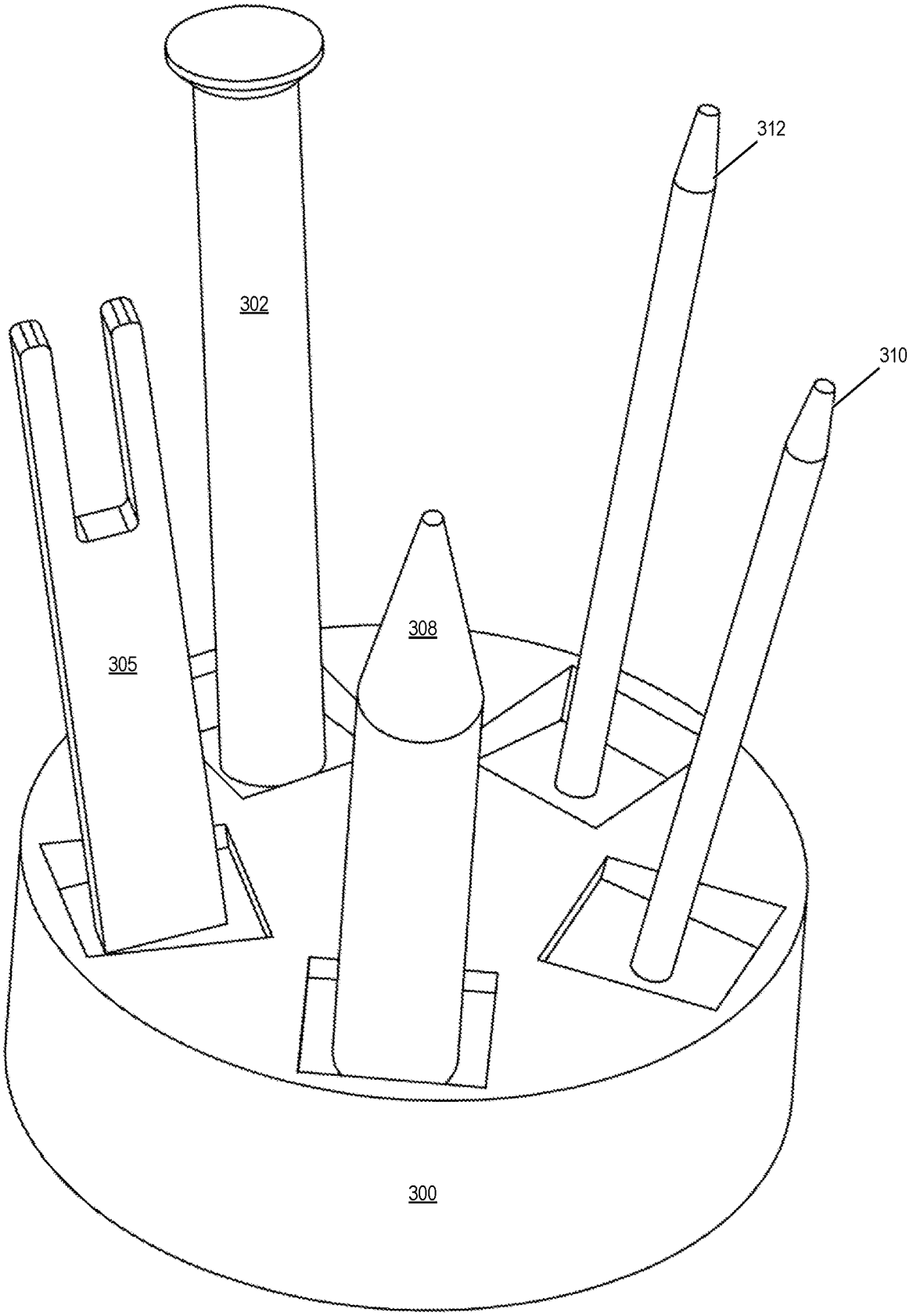
FIG. 3 shows an example in accordance with disclosed embodiments.

Turning to FIG. 3, the end effector (300) is used as part of a fiber polishing system. The end effector (300) includes multiple tools. The tools include the suction gripper (302), the passive features (305), the air nozzle (308), the first water nozzle (310), and the second water nozzle (312). Different types or numbers of tools may be used with the end effector (300).

The suction gripper (302) is a tool of the end effector (300). In one embodiment, the suction gripper (302) is used to grip a polishing disk so that the robot to which the end effector (300) is attached may manipulate the polishing disk.

The passive features (305) form a tool of the end effector (300). In one embodiment, the passive features (305) are used to manipulate the handles and dogs of fiber polishers.

The air nozzle (308) is a tool of the end effector (300). In one embodiment, the air nozzle (308) is a high pressure air nozzle that sprays high pressure air from the end effector (300). The high pressure air may be used to remove excess fluid (e.g., water) from a polishing disk.

The first water nozzle (310) is a tool of the end effector (300). In one embodiment, the first water nozzle (310) is a high pressure water nozzle. The high pressure water may be used to clean a disk prior to using the disk to polish fibers in a fiber polisher.

The second water nozzle (312) is a tool of the end effector (300). In one embodiment, the second water nozzle (312) is a low pressure water spray. The low pressure water from the second water nozzle (312) may be used to mist an amount of water to a polishing disk to polish fibers.

Embodiments may be implemented using a computing system specifically designed to achieve an improved technological result. When implemented in a computing system, the features and elements of the disclosure provide a significant technological advancement over computing systems that do not implement the features and elements of the disclosure. Any combination of mobile, desktop, server, router, switch, embedded device, or other types of hardware may be improved by including the features and elements described in the disclosure. For example, as shown in FIG. 4A, the computing system (400) may include one or more computer processors (402), non-persistent storage (404), persistent storage (406), a communication interface (412) (e.g., Bluetooth interface, infrared interface, network interface, optical interface, etc.), and numerous other elements and functionalities that implement the features and elements of the disclosure. The computer processor(s) (402) may be an integrated circuit for processing instructions. The computer processor(s) may be one or more cores or micro-cores of a processor. The computer processor(s) (402) includes one or more processors. The one or more processors may include a central processing unit (CPU), a graphics processing unit (GPU), a tensor processing units (TPU), combinations thereof, etc.

The input devices (410) may include a touchscreen, keyboard, mouse, microphone, touchpad, electronic pen, or any other type of input device. The input devices (410) may receive inputs from a user that are responsive to data and messages presented by the output devices (408). The inputs may include text input, audio input, video input, etc., which may be processed and transmitted by the computing system (400) in accordance with the disclosure. The communication interface (412) may include an integrated circuit for connecting the computing system (400) to a network (not shown) (e.g., a local area network (LAN), a wide area network (WAN) such as the Internet, mobile network, or any other type of network) and/or to another device, such as another computing device.

Further, the output devices (408) may include a display device, a printer, external storage, or any other output device. One or more of the output devices may be the same or different from the input device(s). The input and output device(s) may be locally or remotely connected to the computer processor(s) (402). Many different types of computing systems exist, and the aforementioned input and output device(s) may take other forms. The output devices (408) may display data and messages that are transmitted and received by the computing system (400). The data and messages may include text, audio, video, etc., and include the data and messages described above in the other figures of the disclosure.

Software instructions in the form of computer readable program code to perform embodiments may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the invention, which may include transmitting, receiving, presenting, and displaying data and messages described in the other figures of the disclosure.

The computing system (400) in FIG. 4A may be connected to or be a part of a network. For example, as shown in FIG. 4B, the network (420) may include multiple nodes (e.g., node X (422), node Y (424)). Each node may correspond to a computing system, such as the computing system shown in FIG. 4A, or a group of nodes combined may correspond to the computing system shown in FIG. 4A. By way of an example, embodiments may be implemented on a node of a distributed system that is connected to other nodes. By way of another example, embodiments may be implemented on a distributed computing system having multiple nodes, where each portion may be located on a different node within the distributed computing system. Further, one or more elements of the aforementioned computing system (400) may be located at a remote location and connected to the other elements over a network.

The nodes (e.g., node X (422), node Y (424)) in the network (420) may be configured to provide services for a client device (426), including receiving requests and transmitting responses to the client device (426). For example, the nodes may be part of a cloud computing system. The client device (426) may be a computing system, such as the computing system shown in FIG. 4A. Further, the client device (426) may include and/or perform all or a portion of one or more embodiments of the invention.

The computing system of FIG. 4A may include functionality to present raw and/or processed data, such as results of comparisons and other processing. For example, presenting data may be accomplished through various presenting methods. Specifically, data may be presented by being displayed in a user interface, transmitted to a different computing system, and stored. The user interface may include a GUI that displays information on a display device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

As used herein, the term "connected to" contemplates multiple meanings. A connection may be direct or indirect (e.g., through another component or network). A connection may be wired or wireless. A connection may be temporary, permanent, or semi-permanent communication channel between two entities.

The various descriptions of the figures may be combined and may include or be included within the features described in the other figures of the application. The various elements, systems, components, and steps shown in the figures may be omitted, repeated, combined, and/or altered as shown from the figures. Accordingly, the scope of the present disclosure should not be considered limited to the specific arrangements shown in the figures.

In the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, or is an "inclusive or" and, as such includes "and." Further, items joined by an or may include any combination of the items with any number of each item unless expressly stated otherwise.

In the above description, numerous specific details are set forth in order to provide a more thorough understanding of the disclosure. However, it will be apparent to one of ordinary skill in the art that the technology may be practiced without these specific details. In other instances, well-known features have not been described in detail to avoid unnecessarily complicating the description. Further, other embodiments not explicitly described above can be devised which do not depart from the scope of the claims as disclosed herein. Accordingly, the scope should be limited only by the attached claims.

What is claimed is:

1. A method for polishing fibers comprising:
manipulating, using an end effector of a robot, a disk;
spraying, using the end effector of the robot, water at the disk using a first water pressure;
spraying, using the end effector of the robot, air at the disk using an air pressure to remove excess water;
misting, using the end effector of the robot, low pressure water at the disk using a second water pressure;
manipulating, using the end effector of the robot, a handle of a fiber polisher; and
manipulating, using the end effector of the robot, one or more dogs of the fiber polisher.

2. The method of claim 1, wherein manipulating the handle comprises:
inserting the disk into the fiber polisher; and
manipulating the handle to close the fiber polisher after the disk is inserted into the fiber polisher.

3. The method of claim 1, wherein manipulating the one or more dogs comprises manipulating the one or more dogs to lock the disk in the fiber polisher.

4. The method of claim 1, wherein the second water pressure is less than the first water pressure.

5. The method of claim 1, wherein:
the end effector includes a suction gripper configured to grip the disk, and
manipulating the disk comprises gripping the disk with the suction gripper.

6. The method of claim 1, wherein:
the end effector includes a first water nozzle, and
spraying water at the disk using the first water pressure comprises spraying water at the disk from the first water nozzle using the first water pressure.

7. The method of claim 6, wherein:
the end effector includes a second water nozzle, and
misting the low pressure water at the disk using the second water pressure comprises misting the low pressure water at the disk from the second water nozzle using the second water pressure.

8. The method of claim 1, wherein:
the end effector includes an air nozzle, and
spraying air at the disk using the air pressure to remove the excess water comprises spraying the air at the disk using the air pressure from the air nozzle to remove the excess water.

9. The method of claim 1, wherein:
the end effector includes passive features, and
manipulating the handle of the fiber polisher comprises manipulating the handle using the passive features.

10. The method of claim 9, wherein:
manipulating one or more dogs of the fiber polisher comprises manipulating the one or more dogs of the fiber polisher using the passive features.

11. An apparatus for polishing fibers comprising:
a fiber polisher including a handle and one or more dogs; and
a robot comprising an end effector configured to:
manipulate a disk,
spray water at the disk using a first water pressure,
spray air at the disk using an air pressure to remove excess water,
mist low pressure water at the disk using a second water pressure,
manipulate the handle of the fiber polisher, and
manipulate the one or more dogs of the fiber polisher.

12. The apparatus of claim 11, wherein, to manipulate the handle, the end effector is configured to:
insert the disk into the fiber polisher; and
manipulate the handle to close the fiber polisher after the disk is inserted into the fiber polisher.

13. The apparatus of claim 11, wherein, to manipulate the one or more dogs, the end effector is configured to:
manipulate the one or more dogs to lock the disk in the fiber polisher.

14. The apparatus of claim 11, wherein the second water pressure is less than the first water pressure.

15. The apparatus of claim 11, wherein the end effector includes:
a suction gripper configured to grip the disk to manipulate the disk.

16. The apparatus of claim 11, wherein the end effector includes:
a first water nozzle configured to spray water at the disk from the using the first water pressure.

17. The apparatus of claim 16, wherein the end effector further includes:
a second water nozzle configured to mist the low pressure water at the disk using the second water pressure.

18. The apparatus of claim 11, wherein the end effector includes:
an air nozzle configured to spray the air at the disk using the air pressure to remove the excess water.

19. The apparatus of claim 11, wherein the end effector includes:
passive features configured to manipulate the handle.

20. The apparatus of claim 19, wherein:
manipulating one or more dogs of the fiber polisher comprises manipulating the one or more dogs of the fiber polisher using the passive features.

* * * * *